US006010572A

United States Patent [19]

Furusawa et al.

[11] Patent Number: 6,010,572

[45] Date of Patent: Jan. 4, 2000

[54] DIP COATING APPARATUS FOR MANUFACTURING ELECTROPHOTOGRAPHIC PHOTORECEPTOR

[75] Inventors: Yasuo Furusawa; Toshiaki Takahashi; Shigeto Hashiba; Kiyoshi Hashimoto; Hirofumi Kawashima, all of Minami-Ashigara, Japan

[73] Assignee: Fuji Xerox Co., Ltd., Tokyo, Japan

[21] Appl. No.: 08/901,208

[22] Filed: Jul. 28, 1997

[30] Foreign Application Priority Data

Aug. 7, 1996 [JP] Japan ..... 8-208348

[51] Int. Cl.[7] ..... B05C 3/00

[52] U.S. Cl. ..... 118/408; 118/429; 118/DIG. 11; 118/DIG. 13

[58] Field of Search ..... 118/408, 429, 118/DIG. 11, DIG. 13; 427/430.1

[56] References Cited

FOREIGN PATENT DOCUMENTS 59-90662 5/1984 Japan .
62-2053 U 1/1987 Japan .

*Primary Examiner*—Laura Edwards
*Attorney, Agent, or Firm*—Oliff & Berridge, PLC

[57] ABSTRACT

A dip coating method, in which a cylindrical member is dipped in a coating solution in a coating solution tank and the coating solution is coated on an outer peripheral surface of the cylindrical member by the cylindrical member being raised, includes the steps of: making the coating solution always overflow from the coating solution tank; dipping the cylindrical member into the coating solution through an opening portion of a cover which is provided above a surface of the coating solution in the coating solution tank, and which has the opening portion through which the cylindrical member can pass, and which has a plurality of plates which are disposed at intervals in a vertical direction; and raising the cylindrical member.

9 Claims, 3 Drawing Sheets

DIP COATING APPARATUS FOR MANUFACTURING ELECTROPHOTOGRAPHIC PHOTORECEPTOR

BACKGROUND OF THE INVENTION

1. Field of the Invention

The present invention relates to a dip coating method and a dip coating apparatus, and in particular, to a dip coating method and a dip coating apparatus which are suited to the coating/formation of a photosensitive layer on the outer peripheral surface of a cylindrical member in the manufacturing of an electrophotographic photoreceptor.

2. Description of the Related Art

Conventionally, inorganic compounds such as selenium, cadmium sulfide, and zinc oxide, and organic compounds exemplified by polyvinyl carbazole have been proposed as photoconductive materials for forming the photosensitive layer of an electrophotographic photoreceptor. Further, in multi-layered-type electrophotographic photoreceptors in which the photosensitive layer is divided into a charge-generating layer and a charge-transporting layer, various organic compounds have been proposed as the charge-generating material and the charge-transporting material and have been used as organic photoreceptors.

The following conventional coating methods have been known as methods for manufacturing such organic photoreceptors: a dip coating method, a spray coating method, a spin coating method, a bead coating method, a wire bar coating method, a blade coating method, a roller coating method, an extrusion coating method, a curtain coating method, and the like. The dip coating method has been widely used in particular as a method for forming a uniform photosensitive layer on the outer peripheral surface of a cylindrical member.

A plural-member simultaneous dip coating method, in which a plurality of cylindrical members are dipped in a coating solution and are simultaneously raised up out of the coating solution, is generally used in the dip coating of an electrophotographic photoreceptor, from the standpoint of improving production. Therefore, in a dip coating method utilizing a coating solution circulating mechanism, a large amount of coating solution is needed for circulation. When a coating solution having a short pot life is used, the amount of coating solution which is disposed of in a short period of time is, of necessity, great, and the efficiency with which materials are used thus deteriorates. Generally, when the dip coating method is used, the pot life of the coating solution is important. However, occasions often arise in which materials having short pot lives must be used due to the characteristics required of the photoreceptor.

With the dip coating method, one reason why the pot life of the coating solution is short is because it is easy for the coating solution to contact the outside air when materials are used for which a hydrolysis reaction occurs easily due to an oxidation reaction or absorption of moisture in the air, and thus, the coating solution deteriorates. In order to prevent deterioration of the coating solution in, in particular, a dip coating method utilizing a coating solution circulating mechanism, it is necessary to restrict the contact of the coating solution with outside air at an overflow surface at the coating solution tank, or at a solution receiving tank which recovers the coating solution which has overflowed from the coating solution tank, or the like.

A conventional apparatus has been proposed in which a cover is provided above the overflow surface as a means for restricting the contact of the coating solution and the outside air. Because the cylindrical member is always dipped in the coating solution, the opening portion, which is formed in the cover and through which the cylindrical member can pass, is made small. A shutter or the like is provided at the opening portion as a means for closing the opening portion at times when no cylindrical member is being dipped in the coating solution. However, a drawback arises in that such a apparatus is complicated.

Further, a structure has been proposed in which a hood is provided, and a means for making the solvent gas, which evaporates from the coating solution, stay at the hood portion is provided (Japanese Patent Application Laid-Open (JP-A) No. 59-30662). In JP-A-59-90662, a plural-level structure is provided in which shielding plates are provided at the inner portion of the hood, and an opening is formed in the wall surface of each level. The solvent gas concentration gradient is provided by the shielding plates in the inner side of the hood such that sudden drying of the coated film is suppressed.

However, in this method, opening portions for providing a concentration gradient are provided at each level. Therefore, when the cylindrical member is dipped in the coating solution, the substitution of the outside air and the solvent gas which is staying at each level is promoted, which is disadvantageous from the standpoint of suppressing contact of the outside air and the coating solution. When suppression of contact of the coating solution with the outside air is realized, the effects of such suppression cannot be expected if the height of the hood is not great enough and the hood diameter is not made as small as possible. However, when the hood diameter is made small and the height of the hood is made large, the drying speed of the coated film is too slow, and a drawback arises in that the characteristics of the formed film deteriorate such as the thickness of the film coated on the surface of the cylindrical member is not uniform, i.e., the so-called sagging phenomenon is marked.

The coating solution tank disclosed in Japanese Utility Model Application Laid-Open (JP-U) No. 62-2053, which does not have a coating solution circulating mechanism, aims to prevent the adhesion of solid materials to the upper portion of the coating solution tank which adhesion is caused by the drying of the coating solution due to the surface of the solution fluctuating up and down due to the coating operation. A baffle plate having a plural-level structure is provided within the coating solution tank. When the surface of the solution falls at the time the cylindrical members are pulled up, the solvent vapor stays at the top portion of the coating tank such that drying is suppressed. However, when the cylindrical members are dipped in the coating solution, the surface of the solution rises. Therefore, at the space at the upper portion of the coating solution tank, there is no substitution of the outside air and the solvent vapor, and there is an extreme reduction in sagging.

The suppression of the contact of the coating solution and the outside air leads to the concentration of the solvent gas in the coating drying zone becoming greater, and as a result, sagging increases. Accordingly, it is desired to suppress the contact between the coating solution and the outside air and to suppress sagging as much as possible.

SUMMARY OF THE INVENTION

An object of the present invention is to provide a dip coating method and a dip coating apparatus in which contact between a coating solution and outside air is suppressed, sagging is prevented so as to suppress deterioration of the characteristics of the formed film, and non-uniformity of the film thickness is prevented.

In order to achieve the above-described object, the present invention provides a dip coating method in which a cylindrical member is dipped in a coating solution in a coating solution tank and the coating solution is coated on an outer peripheral surface of the cylindrical member by the cylindrical member being raised, comprising the steps of: making the coating solution always overflow from the coating solution tank; dipping the cylindrical member into the coating solution through an opening portion of a cover which is provided above a surface of the coating solution in the coating solution tank, and which has the opening portion through which the cylindrical member can pass, and which has a plurality of plates which are disposed at intervals in a vertical direction; and raising the cylindrical member. It is preferable that the plates are each provided with a plurality of the opening portions, and the opening portions correspond to the opening portions provided in adjacent plates such that cylindrical members can pass therethrough. It is also preferable that plural cylindrical members are simultaneously dipped in the coating solution and raised.

Also in order to achieve the above-described object, the present invention provides a dip coating apparatus having a coating solution tank which holds coating solution and into which a cylindrical member is dipped, comprising: a solution receptacle provided at a periphery of the coating solution tank and recovering coating solution which overflows from the coating solution tank; a tank which recovers coating solution from the solution receptacle; means for supplying coating solution within the tank to the coating solution tank; and a cover which is provided above the coating solution tank and the solution receptacle, and which has an opening portion through which the cylindrical member can pass, and which has a plurality of plates disposed at intervals in a vertical direction. It is preferable that the plates are each provided with a plurality of the opening portions, and the opening portions correspond to the opening portions provided in adjacent plates such that cylindrical members can pass therethrough.

Another aspect of the present invention is a method of manufacturing an electrophotographic photoreceptor in which a cylindrical member is dipped in a coating solution, for forming a photosensitive layer, in a coating solution tank and a photosensitive layer is formed on an outer peripheral surface of the cylindrical member by the cylindrical member being raised, comprising the steps of: making the coating solution always overflow from the coating solution tank; dipping the cylindrical member into the coating solution through an opening portion of a cover which is provided above a surface of the coating solution in the coating solution tank, and which has the opening portion through which the cylindrical member can pass, and which has a plurality of plates which are disposed at intervals in a vertical direction; and raising the cylindrical member.

Yet another aspect of the present invention is a apparatus for manufacturing an electrophotographic photoreceptor having a coating solution tank which holds coating solution for forming a photosensitive layer and into which a cylindrical member is dipped, comprising: a solution receptacle provided at a periphery of the coating solution tank and recovering coating solution which overflows from the coating solution tank; a tank which recovers coating solution from the solution receptacle; means for supplying coating solution within the tank to the coating solution tank; and a cover which is provided above the coating solution tank and the solution receptacle, and which has an opening portion through which the cylindrical member can pass, and which has a plurality of plates disposed at intervals in a vertical direction.

A known conductive member used in an electrophotographic photoreceptor may be used as the cylindrical member in the present invention. The coating solution used in the present invention may be a known coating solution which is coated to form, for example, a charge generating layer, a charge transporting layer, an undercoat layer, or a protective layer of an electrophotographic photoreceptor.

Examples of the solvent used in the present invention are alcohols such as methanol, ethanol, isopropanol, and butanol; aliphatic hydrocarbons such as hexane, octane and cyclohexane; aromatic hydrocarbons such as benzene, toluene and xylene; halogenated hydrocarbons such as dichloromethane, dichloroethane, carbon tetrachloride and chlorobenzene; ethers such as dimethylether, diethylether, tetrolhydrofuran and ethylene glycol; ketones such as acetone and methyl ethyl ketone; esters such as methyl acetate, ethyl acetate and butyl acetate; dimethylformaldehyde; dimethylformaraide; dimethylsulfoxide; and the like. The specific gravities of all of these solvents are greater than that of air. The viscosity of the coating solution is preferably in a range of 0.01 mPas to 1000 mPas, and more preferably in a range of 1 mPas to 600 mPas. However, the viscosity can be set appropriately in accordance with the coated film thickness, the coating speed, and the like. Any of known coating solutions for forming a photosensitive layer can be used as the coating solution of the present invention.

In the dip coating method and apparatus of the present invention, the coating solution is always made to overflow from the coating solution tank. The cylindrical member is dipped into the coating solution through an opening portion of the cover which is provided above the surface of the coating solution in the coating solution tank, and which has the opening portion through which the cylindrical member can pass, and which has a plurality of plates which are disposed at intervals in the vertical direction. The cylindrical member is also raised through the opening portion.

Here, the surface of the solution in the coating solution tank is substantially constant when the cylindrical member is being dipped and when the cylindrical member is being raised. When the cylindrical member is being lowered, the plate gaps forming the levels provide resistance such that it is difficult for the outside air and the solvent gas staying within the cover to be substituted with one another. On the other hand, when the cylindrical member is being raised, the solvent gas fills the gaps between the level plates close to the surface of the solution such that the higher the level, the more difficult it becomes for the solvent gas to fill the level. As a result, the drying speed is slow, there is little sagging of the thin film, and the characteristics of the formed film do not deteriorate.

DESCRIPTION OF THE PREFERRED EMBODIMENT

Hereinafter, a preferred embodiment of the present invention will be described on the basis of the drawings.

Figure 1:
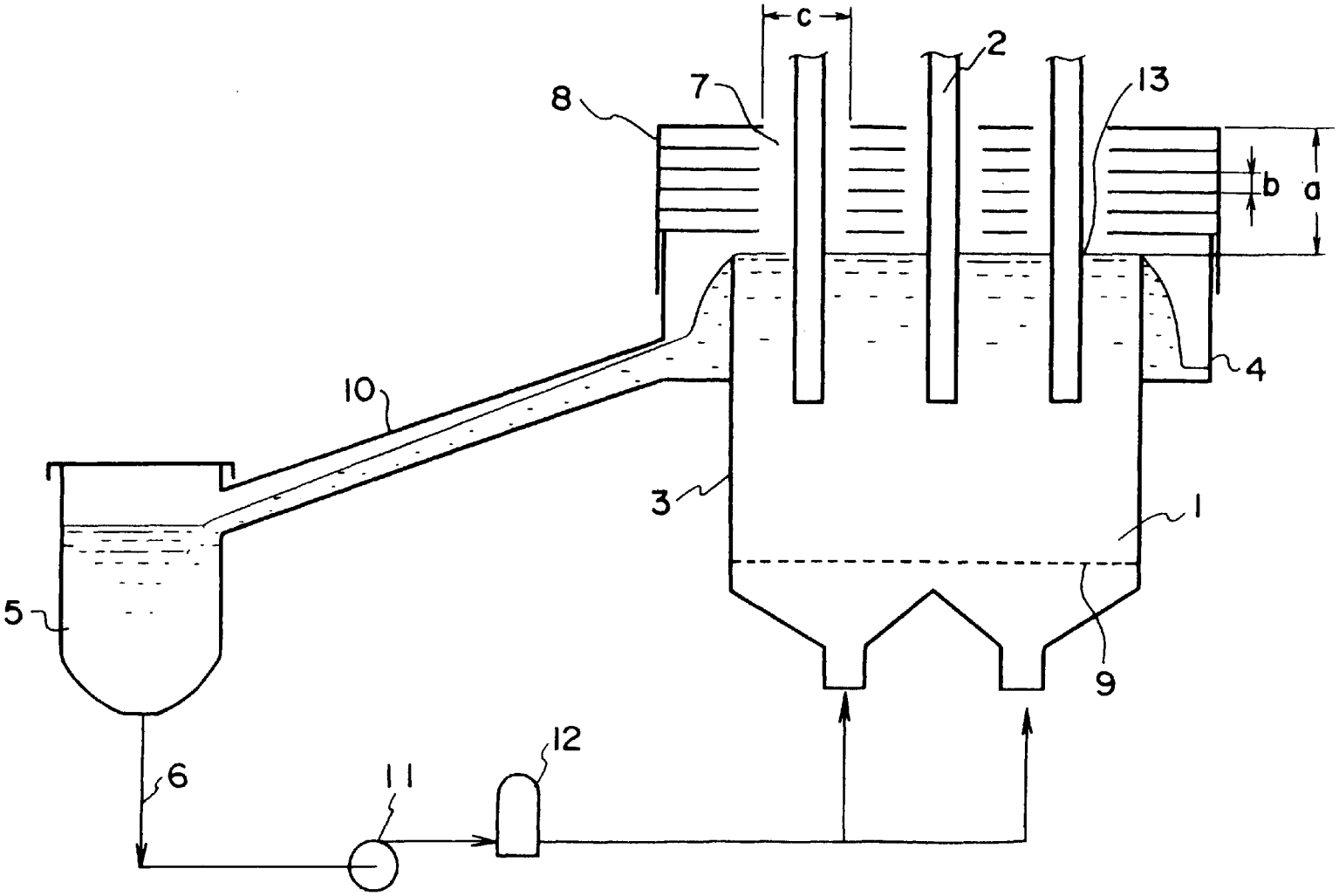
FIG. 1 is a schematic structural view illustrating a preferred embodiment of a dip coating apparatus of the present invention.

FIG. 1 summarily illustrates an embodiment of a plural-member simultaneous dip coating apparatus of the present invention, and illustrates a state in which cylindrical members are being pulled up from a coating solution tank.

The dip coating apparatus has a coating solution tank 3 which holds a coating solution 1 and into which cylindrical members 2 are dipped. The dip coating apparatus is also mainly formed by a solution receptacle 4, a tank 5, a supply pipe 6, and a cover 8. The solution receptacle 4 recovers the coating solution 1 which overflows from the coating solution tank 3. The tank 5 recovers the coating solution 1 from the solution receptacle 4. The supply pipe 6 serves as a means for supplying the coating solution 1 within the tank 5 to the coating solution tank 3. The cover 8 is disposed above the coating solution tank 3 and the solution receptacle 4, has opening portions 7 through which the cylindrical members 2 can pass, and has a plurality of plates which are disposed at intervals in the vertical direction.

The coating solution tank 3 has two bottom portions each having a funnel-shaped cross-section. One end portion of the supply pipe 6 communicates with the respective bottom portions of the coating solution tank 3. A rectifier plate 9 having a plurality of hole portions is provided above the bottom portions. The solution receptacle 4 is formed at the outer periphery of the coating solution tank 31 and is connected via an overflow pipe 10 to the tank 5 which is positioned lower than the solution receptacle 4. A pump 11 and a filter 12 are provided on the path of the supply pipe 6 which connects the tank 5 and the coating solution tank 3.

Figure 2:
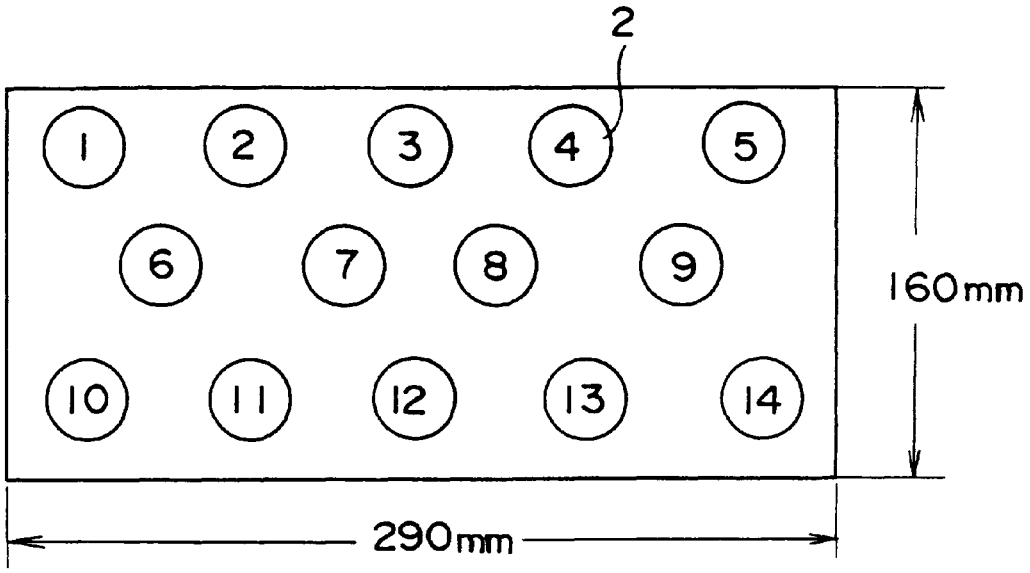
FIG. 2 is a schematic plan view illustrating a preferred embodiment of an arrangement of opening portions through which cylindrical members can pass in the dip coating apparatus of the present invention.

The horizontal direction cross-section of the coating solution tank 3 is rectangular. The cover 8 is provided so as to cover the coating solution tank 3 and the solution receptacle 4 at the outer periphery of the coating solution tank 3. The outer side upper end portion of the solution receptacle 4 is set at a position which is higher than the upper end portion of the coating solution tank 3. Plural levels of plates (six levels in the figure) are disposed at the cover 8. The plate of the lowest level contacts the outer side upper end portion of the solution receptacle 4. As illustrated in FIG. 2, a plurality of the opening portions 7 (14 opening portions 7 in the figure) are formed in each plate in the cover 8. The respective opening portions 7 formed in one plate correspond to the positions of the respective opening portions 7 formed in the adjacent plates such that the cylindrical members can pass therethrough.

Next, the dip coating method in accordance with the dip coating apparatus having the above-described structure will be described.

The coating solution 1 is sent under pressure by the pump 11 from the tank 5 through the supply pipe 6, and is supplied into the coating solution tank 3 via the filter 12. The coating solution supplied into the interior of the coating solution tank 3 is supplied uniformly with respect to the horizontal direction by the rectifier plate 9, overflows from the coating solution tank 3, is collected in the solution receptacle 4 provided at the periphery of the upper end of the coating solution tank 3, and thereafter, flows out through the overflow pipe 10 and is recovered in the tank 5.

Namely, the dip coating apparatus has a circulation mechanism such that, when the cylindrical members 2 are dipped in the coating solution tank 3 and are thereafter pulled up, the coating solution always overflows so that the solution surface 13 within the coating solution tank (i.e., the overflow surface 13) is maintained constant.

In the coating method in accordance with this dip coating apparatus, when the cylindrical members 2 are dipped in the coating solution within the coating solution tank 3, i.e., when the cylindrical members 2 are lowered into the cover 8 from above the cover 8 and outside of the cover 8, the plate spaces forming the levels provide resistance such that it is difficult for the solvent gas staying in the cover 8 and the outside air to be substituted with one another. Further, when the cylindrical members 2 are pulled up, the solvent gas from the solution surface within the coating solution tank 3 and from the films formed on the surfaces of the cylindrical members 2 fills the spaces between the levels close to the surface of the solution, such that the higher the level, the more difficult it becomes for the solvent gas to fill the level. As a result, the drying speed is slow, there is little sagging of the thin film, and the characteristics of the formed film do not deteriorate.

Figure 3:
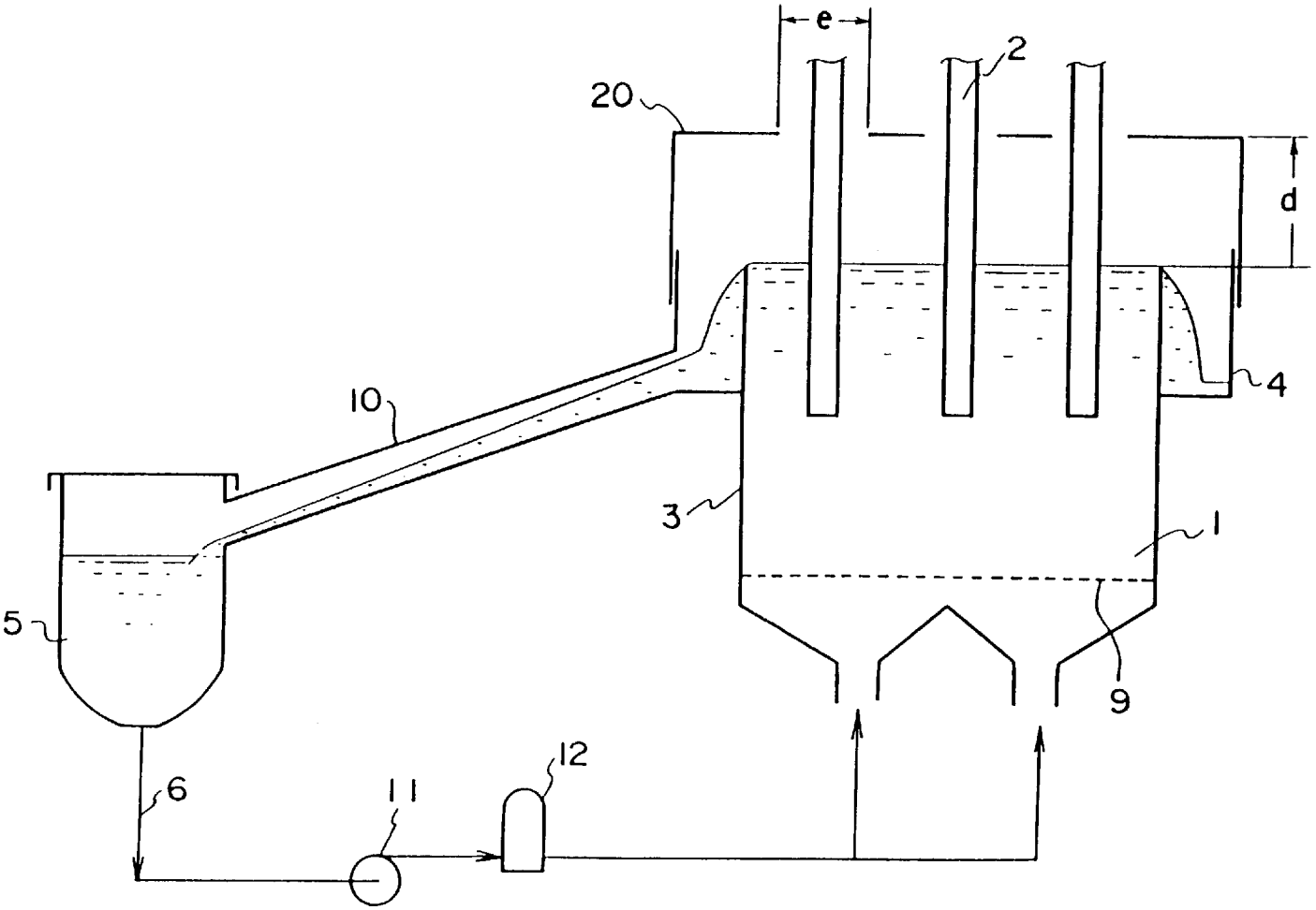
FIG. 3 (PRIOR ART)
FIG. 3 is schematic structural view illustrating an example of a conventional dip coating apparatus.

In a case in which a plural-level structure is not used, i.e., in the case of the apparatus of FIG. 3, when the cylindrical members are dipped, at the time the cylindrical members are lowered into a cover 20 from the outer side above the cover 20, the outside air and the solvent gas staying within the cover 20 are substituted easily, and it is easy for the overflow surface 13 and the surface of the solution in the solution receptacle 4 to contact the air. Further, when the cylindrical members 2 are raised, it is easy for the solvent gas from the solution surface and the formed coated films to fill the interior of the cover 20. The drying of the formed coated films becomes slow, and there is much sagging.

Two or more plates (levels) are formed within the cover 8 in FIG. 1 (there are six levels in FIG. 1). The height a from the overflow surface to the cover top plate and the level interval b are selected arbitrarily in accordance with the physical properties of the coating solution, the required values of the film thickness characteristic, and the like. Further, the level intervals b may respectively be different. Similarly, the plate opening diameters c may respectively be selected arbitrarily in accordance with the diameters of the cylindrical members or the like.

EXAMPLES

Hereinafter, the present invention will be described concretely by the Examples.

Example 1

A mixed solution formed from 100 parts by weight of an organic zirconium compound (trade name: Orgatics ZC540, manufactured by Matsumoto Seiyaku K.K.), 14 parts by weight of a silane coupling agent (trade name: A110, manufactured by Nippon Unicar Co., Ltd.), 7 parts by weight of polyvinyl butyral resin (trade name: S-Lec B-MS, manufactured by Sekisui Chemical Co., Ltd.), and 232 parts by weight of n-butanol was coated onto aluminum pipes (0.75 mmt×30 mm ϕ×340 mm) by using the plural-member simultaneous dip coating apparatus of FIG. 1. At that time, the temperature of the dip coating solution was 24° C. The speed at which the aluminum pipes; were pulled up from the coating solution was 250 mm/min. The solution was coated simultaneously on 14 aluminum pipes which were arranged as illustrated in FIG. 2. The amount of the coating solution in the coating circulation system at that time was 25 liters. The number of levels in FIG. 1 was 10, the height a was 210 mm, the level intervals b were all 20 mm, and the plate opening diameters c were all 39 mm.

Factors contributing to the life of the coating solution were a circulation amount of 10 liters/min, a temperature of 24° C. of the outside air at the periphery of the dip tank, a relative humidity of 35%, and a wind speed of 0.05 m/sec above the cover. After the pipes to which the solution was dried by air, the pipes were placed in a drier and were heat dried for 10 minutes at 170° C. so as to form a undercoating layer. The film thickness sagging values are listed in Table 1. Here, the film thickness sagging value is the smallest of the differences between the average value of the film thickness values at a total of 12 points (50 mm, 160 mm, 300 mm from the top end of the coated film at four points in the peripheral direction at 90° intervals) and the film thickness values at the four points (separated by 90° intervals in the peripheral direction) which are 20 mm from the top end of the coated film.

An interference-type film thickness meter was used as the film thickness meter. A 415 nm absorbancy value of the coating solution was used as a substitute characteristic value for the degree of deterioration of the solution, with larger values indicating more advanced deterioration. The degree of deterioration was examined by measuring the absorbancy immediately after the coating solution was introduced into the coating circulation system, 168 hours thereafter, and 336 hours thereafter. The respective absorbancy values are listed in Table 1. Note that during this period of time, the solution was circulated continuously. Coating of the solution for examining the film thickness sagging values was carried out immediately after the coating solution was introduced and 336 hours after the solution was introduced. "Coating position" refers to the coating positions 1 through 14 illustrated in FIG. 2.

TABLE 1

| | Immediately After Introduction Into Circulation System | 168 Hours After Introduction | 336 Hours After Introduction |
|---|---|---|---|
| Absorbancy (Degree of Deterioration) | 0.06 | 0.10 | 0.25 |
| Coating Position | Film Thickness Sagging Value (μm) | — | Film Thickness Sagging Value (μm) |
| 1 | 0.11 | | 0.12 |
| 2 | 0.09 | — | 0.11 |
| 3 | 0.13 | — | 0.11 |
| 4 | 0.09 | — | 0.13 |
| 5 | 0.10 | — | 0.09 |
| 6 | 0.08 | — | 0.10 |
| 7 | 0.13 | — | 0.09 |
| 8 | 0.13 | — | 0.12 |
| 9 | 0.12 | — | 0.13 |
| 10 | 0.08 | — | 0.09 |
| 11 | 0.11 | — | 0.08 |
| 12 | 0.07 | — | 0.08 |
| 13 | 0.10 | — | 0.09 |
| 14 | 0.12 | — | 0.14 |
| Average | 0.10 | — | 0.11 |

Comparative Example 1

In Comparative Example 1, solution was coated and film thickness sagging and the degree of solution deterioration during continuous circulation were measured wider the same conditions as those in Example 1 except that the cover, which is illustrated in FIG. 3 and does not have a plural-level structure, was used. The results are listed in Table 2. With regard to the configuration of the cover, the height d from the overflow surface was 210 mm, and the plate opening diameter e was 39 mm.

TABLE 2

| | Immediately After Introduction Into Circulation System | 168 Hours After Introduction | 336 Hours After Introduction |
|---|---|---|---|
| Absorbancy (Degree of Deterioration) | 0.06 | 0.18 | 0.44 |
| Coating Position | Film Thickness Sagging Value (μm) | — | Film Thickness Sagging Value (μm) |
| 1 | 0.16 | — | 0.22 |
| 2 | 0.19 | — | 0.22 |
| 3 | 0.19 | — | 0.20 |
| 4 | 0.13 | — | 0.19 |
| 5 | 0.21 | — | 0.21 |
| 6 | 0.18 | — | 0.21 |
| 7 | 0.20 | — | 0.17 |
| 8 | 0.19 | — | 0.19 |
| 9 | 0.19 | — | 0.22 |
| 10 | 0.15 | — | 0.22 |
| 11 | 0.18 | — | 0.16 |
| 12 | 0.19 | — | 0.19 |
| 13 | 0.14 | — | 0.21 |
| 14 | 0.18 | — | 0.21 |
| Average | 0.18 | — | 0.21 |

Example 2

Film thickness sagging and the degree of deterioration of the solution were examined under the same conditions as in Example 1, except that the number of levels of the plural-level plates was 5 and the height a was 110 mm. The results are listed in Table 3.

TABLE 3

| | Immediately After Introduction Into Circulation System | 168 Hours After Introduction | 336 Hours After Introduction |
|---|---|---|---|
| Absorbancy (Degree of Deterioration) | 0.06 | 0.15 | 0.36 |
| Coating Position | Film Thickness Sagging Value (μm) | — | Film Thickness Sagging Value (μm) |
| 1 | 0.09 | — | 0.11 |
| 2 | 0.10 | — | 0.11 |
| 3 | 0.08 | — | 0.09 |
| 4 | 0.07 | — | 0.08 |
| 5 | 0.07 | — | 0.09 |
| 6 | 0.09 | — | 0.10 |
| 7 | 0.10 | — | 0.10 |
| 8 | 0.10 | — | 0.09 |
| 9 | 0.09 | — | 0.08 |
| 10 | 0.09 | — | 0.07 |
| 11 | 0.07 | — | 0.10 |
| 12 | 0.07 | — | 0.10 |
| 13 | 0.09 | — | 0.07 |
| 14 | 0.11 | — | 0.08 |
| Average | 0.087 | — | 0.091 |

Comparative Example 2

For comparison, the film thickness sagging and the degree of deterioration of the solution were examined under the same conditions as Example 2, except that the cover was a cover such as that illustrated in FIG. 3 which is not a plural-level structure. With regard to the configuration of the cover, the height d from the overflow surface was 110 mm, and the plate opening diameter e was 39 mm. The results are listed in Table 4.

TABLE 4

| | Immediately After Introduction Into Circulation System | 168 Hours After Introduction | 336 Hours After Introduction |
|---|---|---|---|
| Absorbancy (Degree of Deterioration) | 0.06 | 0.33 | 0.75 |
| Coating Position | Film Thickness Sagging Value (μm) | — | Film Thickness Sagging Value (μm) |
| 1 | 0.12 | | 0.14 |
| 2 | 0.09 | — | 0.12 |
| 3 | 0.13 | — | 0.12 |
| 4 | 0.11 | — | 0.16 |
| 5 | 0.10 | — | 0.11 |
| 6 | 0.14 | — | 0.13 |
| 7 | 0.14 | — | 0.14 |
| 8 | 0.13 | — | 0.13 |
| 9 | 0.11 | — | 0.12 |
| 10 | 0.15 | — | 0.12 |
| 11 | 0.09 | — | 0.13 |
| 12 | 0.12 | — | 0.13 |
| 13 | 0.09 | — | 0.15 |
| 14 | 0.14 | — | 0.12 |
| Average | 0.118 | — | 0.135 |

As can be seen from Tables 1 through 4, in a case in which a cover having a plural-level structure is used (Example 1), even if a mechanism for circulating the coating solution is used, as compared with a case in which a cover not having a plural-level structure is used (Comparative Example 1), there is little deterioration of the solution over time, and the film thickness sagging value is extremely low in the initial stages and also after time has passed.

In accordance with the present invention, sagging of the films formed on the cylindrical members can be held back, the speed of deterioration of the solution can be suppressed, and stable dip coating for cylindrical members can be carried out.

What is claimed is:

1. A dip coating apparatus having a coating solution tank which holds coating solution and into which a cylindrical member is dipped, comprising:

a coating solution tank;

a solution receptacle provided at a periphery of the coating solution tank and recovering coating solution which overflows from the coating solution tank;

a recovery tank which recovers coating solution from said solution receptacle;

means for supplying coating solution within said recovery tank to the coating solution tank; and a cover which is provided above the coating solution tank and said solution receptacle, and has a plurality of opening portions through which the cylindrical member can pass, said cover having a plurality of plates which are disposed at intervals in a vertical direction and are parallel to a surface of the coating solution in the coating solution tank and have a plurality of opening portions through which the cylindrical member can pass side surfaces of the cover at positions between the plates being solid surfaces in which no opening portions are formed.

2. A dip coating apparatus according to claim 1, wherein the opening portions are provided in adjacent plates such that cylindrical members can pass therethrough.

3. A dip coating apparatus according to claim 1, wherein the only opening portions provided in the cover are the opening portions through which the cylindrical member can pass.

4. A dip coating apparatus according to claim 1, wherein a plurality of cylindrical members can be dip-coated simultaneously in said dip coating apparatus.

5. An apparatus for manufacturing an electrophotographic photoreceptor having a coating solution tank which holds coating solution for forming a photosensitive layer and into which a cylindrical member is dipped, comprising:

a coating solution tank;

a solution receptacle provided at a periphery of the coating solution tank and recovering coating solution which overflows from the coating solution tank;

a recovery tank which recovers coating solution from said solution receptacle;

means for supplying coating solution within said recovery tank to the coating solution tank; and a cover which is provided above the coating solution tank and said solution receptacle and has a plurality of opening portions through which the cylindrical member can pass, said cover having a plurality of plates which are disposed at intervals in a vertical direction and are parallel to a surface of the coating solution in the coating solution tank and have a plurality of opening portions through which the cylindrical member can pass, side surfaces of the cover at positions between the plates being solid surfaces in which no opening portions are formed.

6. An apparatus for manufacturing an electrophotographic photoreceptor according to claim 5, wherein the opening portions are provided in adjacent plates such that cylindrical members can pass therethrough.

7. An apparatus for manufacturing an electrophotographic photoreceptor according to claim 5, wherein the coating solution for forming a photosensitive layer includes a hydrolytic material.

8. An apparatus for manufacturing an electrophotographic photoreceptor according to claim 5, wherein the only opening portions provided in the cover are the opening portions through which the cylindrical member can pass.

9. An apparatus for manufacturing an electrophotographic photoreceptor according to claim 5, wherein a plurality of cylindrical members can be dip-coated simultaneously in said apparatus for manufacturing an electrophotographic photoreceptor.

* * * * *